United States Patent [19]

Ausnit et al.

[11] Patent Number: 4,812,074

[45] Date of Patent: Mar. 14, 1989

[54] APPARATUS FOR MAKING BAG MATERIAL

[75] Inventors: Steven Ausnit, New York, N.Y.; Robert S. Nocek, Stamford, Conn.

[73] Assignee: Minigrip, Inc., Orangeburg, N.Y.

[21] Appl. No.: 62,391

[22] Filed: Jun. 15, 1987

Related U.S. Application Data

[62] Division of Ser. No. 770,886, Aug. 30, 1985, abandoned.

[51] Int. Cl.[4] ..... B31B 1/84

[52] U.S. Cl. ..... 493/213; 493/214; 493/381; 493/927; 156/204

[58] Field of Search ..... 493/213, 214, 215, 231, 493/193, 381, 927; 156/284, 227

[56] References Cited

U.S. PATENT DOCUMENTS

| | | | |
|---|---|---|---|
| Re. 28,969 | 9/1976 | Naito | 150/3 |
| 459,461 | 9/1891 | Puckett | 206/617 |
| 2,916,197 | 12/1959 | Detrie et al. | 383/63 |
| 3,057,539 | 10/1962 | Leary, Jr. | 493/212 |
| 3,084,793 | 4/1963 | Pitman | 206/617 |
| 3,198,228 | 8/1965 | Naito | 138/115 |
| 3,282,493 | 11/1966 | Kamins et al. | 383/63 |
| 3,543,343 | 12/1970 | Staller et al. | 18/14 |
| 3,948,705 | 4/1976 | Ausnit | 383/63 |
| 4,101,355 | 7/1978 | Ausnit | 156/66 |
| 4,341,575 | 7/1982 | Herz | 156/66 |
| 4,372,793 | 2/1983 | Herz | 156/66 |
| 4,430,070 | 2/1984 | Ausnit | 493/215 |
| 4,528,224 | 7/1985 | Ausnit | 156/66 |
| 4,558,556 | 12/1985 | Jostler | 383/37 |
| 4,601,694 | 7/1986 | Ausnit | 493/213 |
| 4,663,915 | 5/1987 | Van Erden et al. | 493/214 |

*Primary Examiner*—Frederick R. Schmidt
*Assistant Examiner*—Robert Showalter
*Attorney, Agent, or Firm*—Hill, Van Santen, Steadman & Simpson

[57] ABSTRACT

An apparatus is disclosed for making bag material having a bag wall sheet or film folded to provide a closed folded top for each bag, a zipper strip having a web being nested within the bag top fold and having the margins of the web carrying recloseable zipper profiles, and at least one of the margins remaining unattached relative to the bag wall.

5 Claims, 3 Drawing Sheets

APPARATUS FOR MAKING BAG MATERIAL

This is a division of application Ser. No. 770,886, filed Aug. 30, 1985, now abandoned.

BACKGROUND OF THE INVENTION

This invention relates to the art of making zipper equipped plastic bags and is more particularly concerned with a new and improved bag, material for making such bag, and a method and apparatus.

Plastic bags equipped with zippers integrally extruded therewith are exemplified in U.S. Pat. No. Re. 28,959. Integral extrusion of the thin bag film and the greater cross-sectional mass of the zipper profiles presents manufacturing problems, in particular having to do with the speed of manufacture. Increased production and the consequent manufacturing economies are important in what has become a very competitive market. Therefore, there is a constant effort toward improving and lowering the cost of production.

U.S. Pat. No. 3,543,343 discloses another example of integrally extruded profiles on a tubular film. In addition, this patent discloses equipping a freshly extruded tubular film with separately prefabricated complementary fastener profile strips. The integrally extruded profiles have the disadvantages already described in connection with U.S. Pat. No. Re. 28,959. Attachment of individual fastener strips is a complicated matter, and there is also the problem of attaining a reasonable degree of accuracy in alignment of the individually attached zipper strips.

In addition, U.S. Pat. No. 3,543,343 discloses the feature of fixing in the top fold of the bag material, separate from the integral zipper film structure, a tear thread or string. No indication is given as to how the end of the tear string is to be manipulated for opening a bag.

U.S. Pat. No. 4,101,355 discloses the fusion or adhesive attachment of zipper strips which carry complementary profiles which are adapted to interlock upon folding of the strips along a central fold line. However, this disclosure teaches securing all of the base or the base material on both sides of the profile, i.e. the lateral side flanges of each strip, to the bag film material.

U.S. Pat. No. 4,341,575 shows a similar arrangement as in U.S. Pat. No. 4,101,355 but is limited to attachment of the entire base of the zipper strip, including lateral side flanges, to the bag film.

U.S. Pat No. 4,430,070 discloses the securing of minor area of each of the base portions of the zipper strips directly back of the profiles thereof, whereby there can be a hinging of the profiles at the inner side of the bag. Each of the complementary zipper strips is independently attached to the bag body film spaced from the open end of the bag.

SUMMARY OF THE INVENTION

An important object of the present invention is to provide a new and improved bag, bag making material, method and apparatus which will provide for folded tops on the bags, having accurately attached zipper means wherein the profile portions of the zipper means are free from the bag wall film, and wherein the profiles are accurately and permanently aligned with each other and the zipper-opening pull flanges automatically are of heavier gauge, i.e. thickness than the bag walls, which facilitates opening of the profiles and insures that there is no tearing at the joint between zipper and film since they are always grasped together during profile opening, i.e. bag opening, manipulation.

To this end, the present invention provides a bag having a top, opposite sides, a bottom and opposite walls, an integral fold connecting the walls at the top of the bag, the walls being secured together along the opposite sides of the bag and the walls being initially separated from one another along the bottom to provide an opening for filling of the bag through the opening whereafter the opening is closed, and a folded zipper strip having complementary separate profiles along opposite margins, a folded web intermediate and connecting the margins, the folded web being nested in the bag top fold, means securing the web to the fold, and the margins being unattached and loose, throughout at least the full width of the profiles, relative to the walls so that the walls can swing away from the margins and the profiles.

There is also provided by the present invention a new and improved high speed method of and an apparatus for making the bag material as well as for making the bags.

Further, the present invention provides a new and improved tear thread arrangement for bags of the general type described.

BRIEF DESCRIPTION OF THE DRAWINGS

Other objects, features and advantages of the invention will be readily apparent from the following description of a representative embodiment thereof, taken in conjunction with the accompanying drawings, although variations and modifications may be effected without departing from the spirit and scope of the novel concepts embodied in the disclosure and in which.

DETAILED DESCRIPTION

Figure 1:
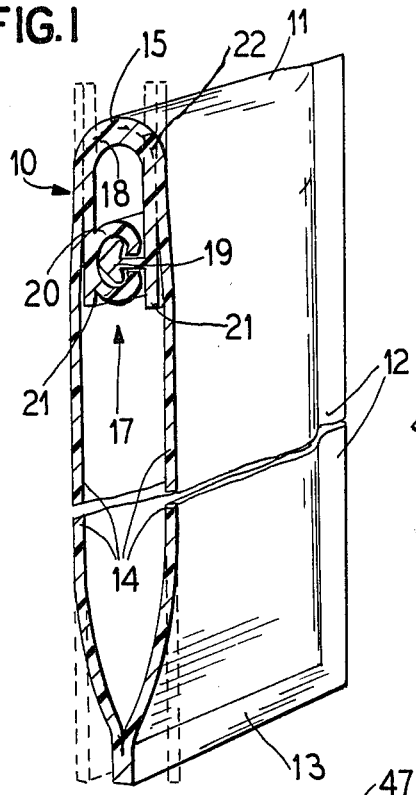
FIG. 1 is a fragmental illustrative view of a bag embodying the invention.
Figure 2:
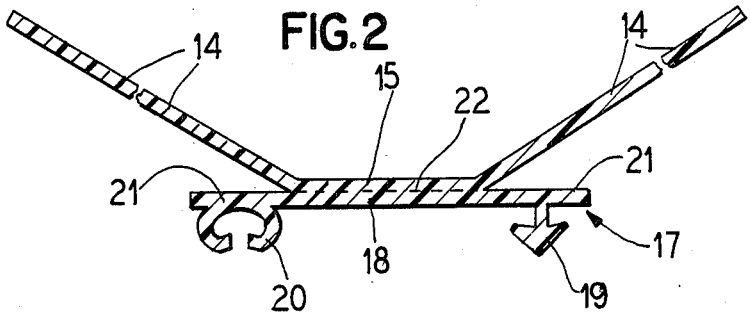
FIG. 2 is a more or less schematic view showing the bag making material for the bag of FIG. 1.

Referring now to FIGS. 1 and 2, a bag 10 has a top 11, opposite sides 12 (only one being shown but it being understood that the opposite side is a duplicate of the side shown), a bottom 13, and opposite walls 14. The walls 14,which are desirably produced from thin plastic film such as polyethylene or the like, are secured together as by means of heat sealing along the opposite sides 12 of the bag and are initially separated from one another along the bottom 13 as shown in dash outline in FIG. 1 to provide an opening, for filling of the bag through the opening whereafter the opening is closed as by means of heat sealing. An integral fold 15 connects the walls 14 at the bag top 11.

A folded zipper strip 17 is nested in the bag fold 15. The zipper strip has a web 18 with complementary separable profiles 19 and 20 along opposite margins 21. The web 18 is folded and is nested in the fold 15 and is secured by means such as fusion heat sealing 22, adhesive, or the like.

As shown in FIG. 1, and in a more exaggerated form in FIG. 2, the margins 21 and the profiles 19 and 20 are entirely unattached and loose relative to the walls 14 so that the walls 14 can swing away from the margins and the profiles 19 and 20. This is particularly advantageous for assuring that the zipper 17 will remain closed even though there may be considerable puffing out of the bag walls after contents have been filled into the bag since any stress that might be directed toward the top of the bag by the bag walls is localized in the top fold 15 and the folded web 18 nested and secured therein, relieving stress from the zipper 17. After the bag has been opened as by cutting open the top 11, as indicated in dash outline, the resulting pull flanges can be manipulated to pull the zipper 17 open, that is to pull the interlocked profiles 19 and 20 apart. To close the zipper 17 it is merely necessary to push the profiles 19 and 20 toward one another into interlocking engagement. This is, of course, facilitated by having the zipper 17 formed from extruded plastic material, such as polyethylene, or other suitable plastic.

Figure 3:
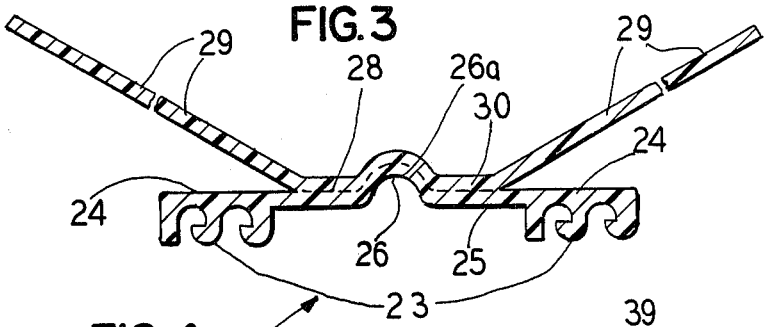
FIG. 3 is a view similar to FIG. 2, but showing a modified fastener, or zipper, structure.

Although as shown in FIGS. 1 and 2, the profiles 19 and 20 are of the single arrow shaped rib and complementary groove type, the invention is equally adaptable for providing the complementary profiles in the form shown in FIG. 3 wherein multiple generally hook-shape rib and groove profiles 23 are shown. In other respect the bag making material of FIG. 3 is generally similar to the bag making material of FIGS. 1 and 2 in that the profiles 23 are carried by opposite margins 24 at opposite sides of an intermediate web 25 of a zipper strip 27 which is secured by means 28 to bag walls 29 which are adapted to be folded along an area 30, similarly as the fold 15 is formed in FIG. 1. However, to facilitate accurate bending of the web 25 along its longitudinal center, a crease 26 may be formed which projects from the plane of the web opposite the profiles 23 as may be noted by a slight hump 26a. Here, the profiles are brought together accurately when the web 25 is folded along the crease line. If desired, of course, the crease 26 may also be formed in the web 18 in FIG. 2.

Figure 4:
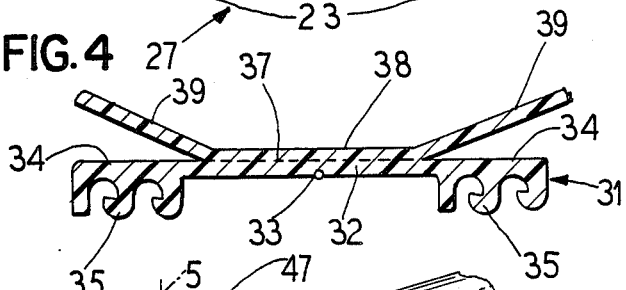
FIG. 4 is a view similar to FIG. 3, but showing a tear strip incorporated with the zipper structure.
Figure 6:
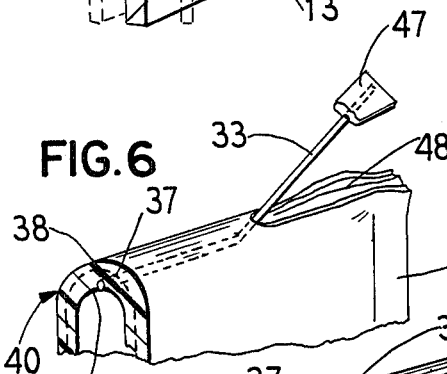
FIG. 6 is a fragmentary view showing operation of the tear strip for opening the bag.

FIG. 4 is similar to FIG. 3, but a fastener strip 31 is shown having an intermediate web 32 provided with a tear cord or thread 33. In this instance, the fastener strip web 32 has, similarly as in the other forms of the invention described, opposite margins 34 carrying multi-rib and groove separable zipper profiles 35. By a suitable securing means 37, the web 32 is secured to a longitudinal area 38 of bag walls 39 leaving the margins 34 and the profiles 35 free from the bag walls 39. In a desirable construction, the tear thread 33 is secured to that surface of the web which will face toward the interconnected zipper profiles when the bag material is folded in the manner depicted in FIGS. 5 and 6. By preference, the tear thread 23 is embedded at least partially in the adjacent surface of the web 32. This may be effected during extrusion of the fastener strip 31 or subsequently. If desired, the web 32 may be formed with a longitudinal crease similar to the crease 26 in FIG. 3 and the thread 33 located in the crease.

In producing bags 40 from the material described in connection with FIG. 4, the bag walls 39 are folded toward one another along the area 38, whereby the web 32 of the zipper strip 31 is likewise folded, and the zipper profiles 35 are desirably interlocked. At their bottom ends 41, the bags 40 are left open until they are filled.

For convenience in filling, the bags 40 may be left in a chain connected together by one or more integral links, herein comprising a link 42 adjacent to the bottom ends 41, and a link 43 desirably provided at the folded top ends of the bags and including the tear cord or thread 33. In this instance, the bags 40 are maintained in spaced edgewise relation to one another by means of a separating slot 44, with the links 42 and 43 bridging across the slot. Conveniently, the links 42 and 43 are formed coincident with fusion sealing of side closing seams 45 along the adjacent sides of the bags. For separating the bags from one another the links 43 and 44 are severed along a median line S. Thereby, the top link 43 provides respective starter tabs 47 in line with the folded top ends of the bags and more particularly containing an extension of the tear thread 33. As a result, by breaking off a tab 47 and pulling upwardly on the attached tear thread 33, the folded top of the bag, including the folded web 32, can be readily torn open as indicated at 48 in FIG. 6 for opening the bag which can then be resealed by means of the zipper 31.

Figures 7, 8:
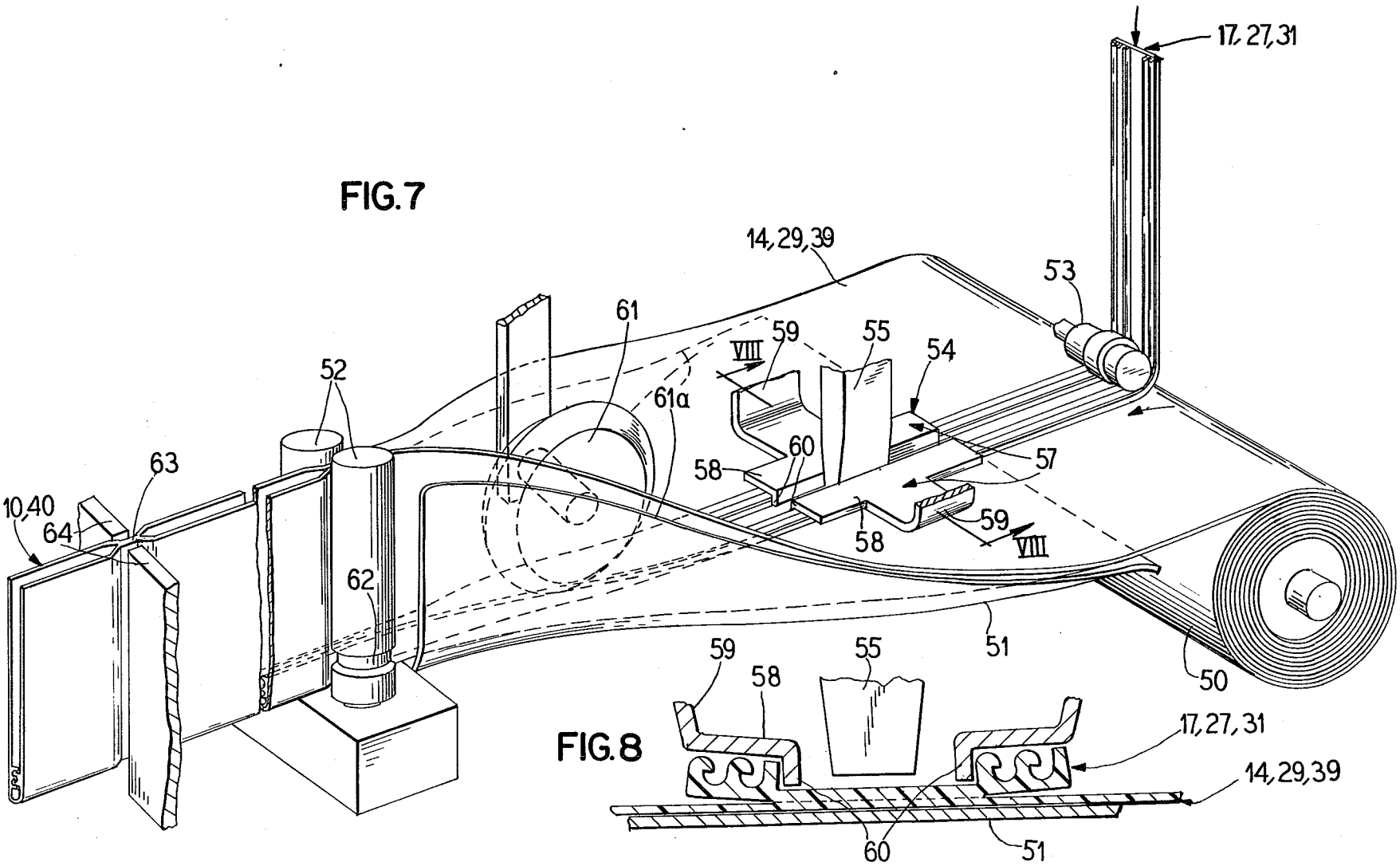
FIG. 7 is a schematic illustration of apparatus for producing bag making material according to the present invention.
FIG. 8 is an enlarged fragmentary sectional detail view taken substantially along the line VIII—VIII in FIG. 7.

For producing bag making material of the kind described, the method and apparatus exemplified in FIGS. 7 and 8 may be employed. Bag wall film 14, 29, 39, as the case may be, is desirably fed from a prefabricated roll 50 to a supporting table 51 along which the material is drawn as by means of driving pinch rolls 52. At the roll 50 or at the table 51, zipper strip 17, 27, 31, as the case may be, if fed from suitable source to the web 14, 29, 39. Although the roll 50 shows prefabricated film material and the zipper strip 17, 27, 31 is shown as prefabricated strip which may be derived from a roll (not shown), both or either of the film and zipper strip may be derived directly from extrusion apparatus and cured or partially cured in the production stream to the point of joinder described. Means such as a guide and joinder roll 53 guides the zipper strip into assembly with the film.

After the film and zipper strip have been assembled guide means 54 guides the zipper strip accurately in association with a sealing device 55 which may be an electronic heater or ultrasonic horn, or wheel or the like. The guide means 54 comprises a pair of complementary plates 57 each of which has an overlying hold-down plate 58 mounted on a support 59 attached to suitable frame (not shown) of the apparatus. The plates 57 are elongated in the machine or production path direction and serve as holddown devices overlying the zipper profiles along the opposite margins of the zipper strip. As guides for accurately guiding the zipper strip as it travels longitudinally with the bag wall film, each of the plates 58 has a depending guide flange 60 engaging along the adjacent inner edges of the profiles, thereby providing a simple and effective means for guiding the zipper on and along the film for attachment thereto. The plates 58 and the flanges 60 also serve as heat shields against heating of the profiles and the marginal portions of the zipper strip webs. This assures that only the intermediate portion of the zipper strip webs will be heated and fused to the bag wall film. Furthermore, the heating means attaching the zipper to the film can also be simple and require minimum adjustment.

Adjacently downstream from the guiding means 54 and the fusing means 55, the now attached fastener strip and the film are folded as by means of a creasing roll 61 and guiding plates 61*a*, and the rolls 52 cooperating therewith to cause interlocking of the zipper profiles. The latter function is facilitated by respective guide grooves 62 in the rollers 52 located to receive the zipper profile areas of the zipper strips. Downstream from the folding, driving and guide rolls 52, the folded bag making material may be cross sealed as shown at 63 by means of cross sealing fusion bars 64, or the like.

As shown, the finished, inverted, open bottom bags 10, 40,as the case may be, are oriented with their open bottoms ready to receive contents therein. This may be effected in an adjacent downstream location, or the bag making material may be rolled up and the bags subsequently filled at a bag filling station.

It has been found that even greater resistance to separation or opening of the zipper due to internal pressures within the bag can be attained by virtue of the structure exemplified in the bag 65 (FIG. 9) which may be desirable for certain applications. Similarly as the bag illustrated in FIG. 1 or FIG. 5, the bag 65 has a top closure fold 67, side walls 68, opposite sealed vertical edges 69 and a bottom end which is provided with a closure seal 70 when the bag has been filled. A zipper 71 has a web 72 which is secured within the fold 67 by means 73 exemplified as heat sealing but which may be adhesive if preferred. Opposite margins 74*a* and 74*b* of the web 72 carry respective complementary separably interengagable zipper profiles 75 and 77. In this instance, one of the zipper profile carrying margins 74*a* is free from attachment to the adjacent bag wall panel 68, while the opposite margin 74*b* from its edge and throughout the width of its zipper profile 77 is attached to the adjacent bag wall panel 68 as indicated at 73*a*.

Figure 10:
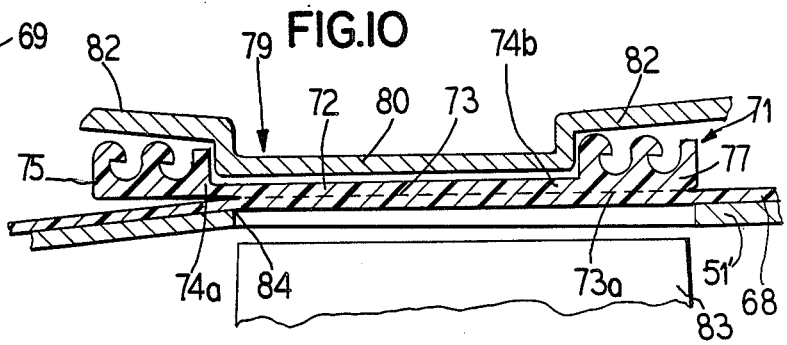
FIG. 10 is a more or less schematic view showing how the material for the bag of FIG. 9 is adapted to be made.

As shown in FIG. 10, joining of the zipper 71 to the bag wall material 68 is adapted to be effected in substantially the manner described in connection with FIGS. 7 and 8 with slight modification primarily in that instead of applying the fusion energy to the top of the assembly, for securing the parts it is applied underneath as will be explained. The bag wall web material 68 and the strip of material for the zipper 71 are assembled together and travel longitudinally along supporting means comprising a table 51'. Hold down and guide means 79 cooperates with the zipper ribbon 71 after assembly thereof with the bag wall film sheet 68. A hold down panel 80 overlies the web 72. Angular side guide flanges 81 cooperate with the adjacent edges of the zipper profiles 75 and 77 to maintain longitudinal travel accuracy of the zipper 71, and generally horizontally extending hold down flanges 82 overlie the profiles 75 and 77.

For securing the zipper member 71 to the film 68, means 83 are provided desirably in the form of an electronic heater, ultrasonic horn, hot air nozzle, or the like, which focuses fusion energy through a slot 84 in the table 78. The slot 84 is located to expose the film 68 for the fusion energy application where it engages the zipper member web 72 and the zipper margin carrying the profile 77, while leaving the margin carrying the profile 75 free from the fusion energy application. Thereby the fusion joinder 73 and 73*a* is effected continuously as the film and zipper assembly travels across the slot 84. Otherwise, the apparatus for producing the bag material and dividing it into bag sections may be substantially as described in respect to FIG. 7.

Figure 11:
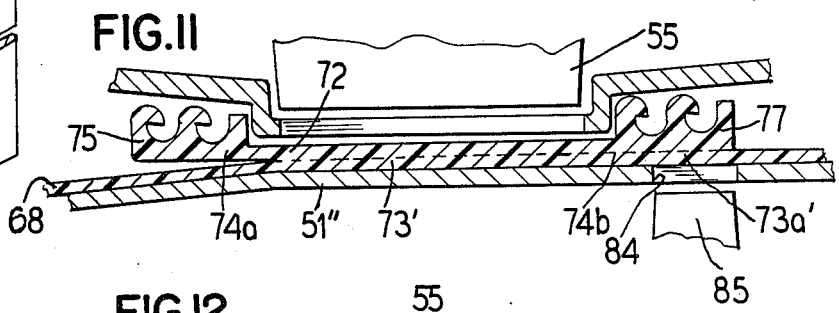
FIG. 11 is a more or less schematic illustration of a further modification in the bag making material and how it is adapted to be made.

Another modification is shown in FIG. 11, which, in effect, combines the techniques of FIGS. 8 and 10. The table 51'' has a fusion energy focusing slot 84 which exposes only a portion of the zipper web margin 74*b* carrying the profile 77 whereby to anchor that area of the zipper margin 74*b* to the film 68 by means of fusion energy supplied by a device 85. On the other hand, the remainder of the apparatus depicted in FIG. 11 may be substantially the same as in FIG. 8, and the same description will apply to the similarly identified parts in FIG. 11. The net effect of securing the zipper profile 77 portion and the zipper web 72 will be substantially the same as described for FIGS. 9 and 10, in that the web 72 will be fusedly attached as indicated at 73' throughout its width except for the margins 74*a*, while the margin 74*b* carrying the zipper profile 77 will be partially fusion secured at 73*a'*.

Figure 9:
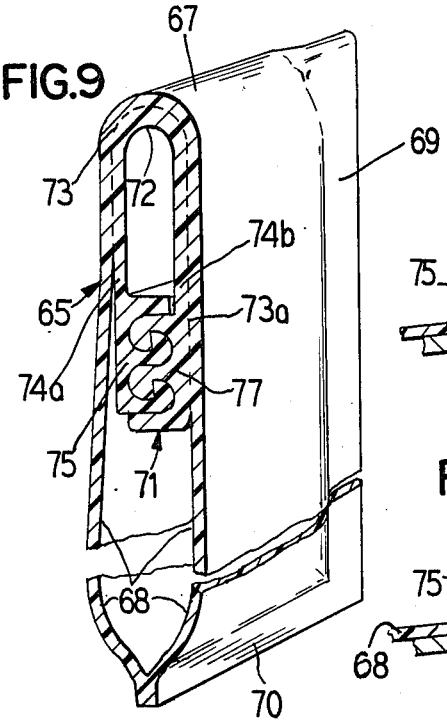
FIG. 9 is a fragmentary illustrative view of a modified construction of the bag, embodying the invention.
Figure 12:
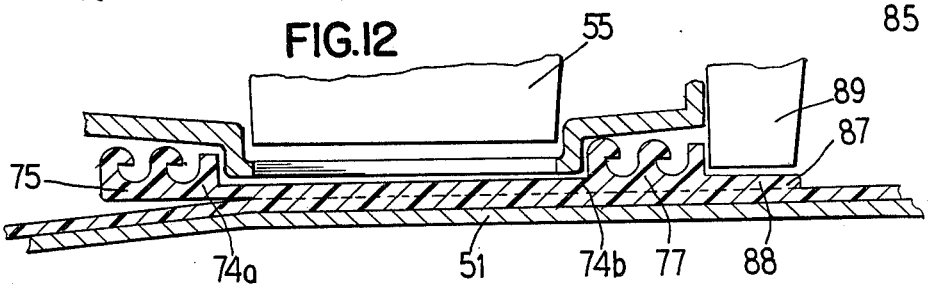
FIG. 12 is a more or less schematic illustration of a further modification in the bag making material illustrating a method of making the same.

In a further modification as shown in FIG. 12, the zipper margin 74*b* which carries the zipper profile 77 has a flange extension 87 which is fused as shown at 88 to the bag wall film 68, thereby attaining substantially the same effect as described for the bag structure of FIG. 9. That is, the margin 74*b* carrying the zipper profile 77 is attached to the film 68 while the margin 74*a* carrying the zipper profile 75 remains unattached. A fusion energy producing device 89 focused onto and through the flange extension 87 to the web 68 is adapted to effect the fusion joinder or securement 88. Otherwise, the apparatus shown is substantially the same as the apparatus in FIG. 8 and the same description applies to the elements identified by the same reference numerals.

Tests have revealed that significantly improved resistance to opening of the zipper due to internal pressures within the bag are attained by means of the expedient described in connection with FIGS. 9 through 12.

Figure 5:
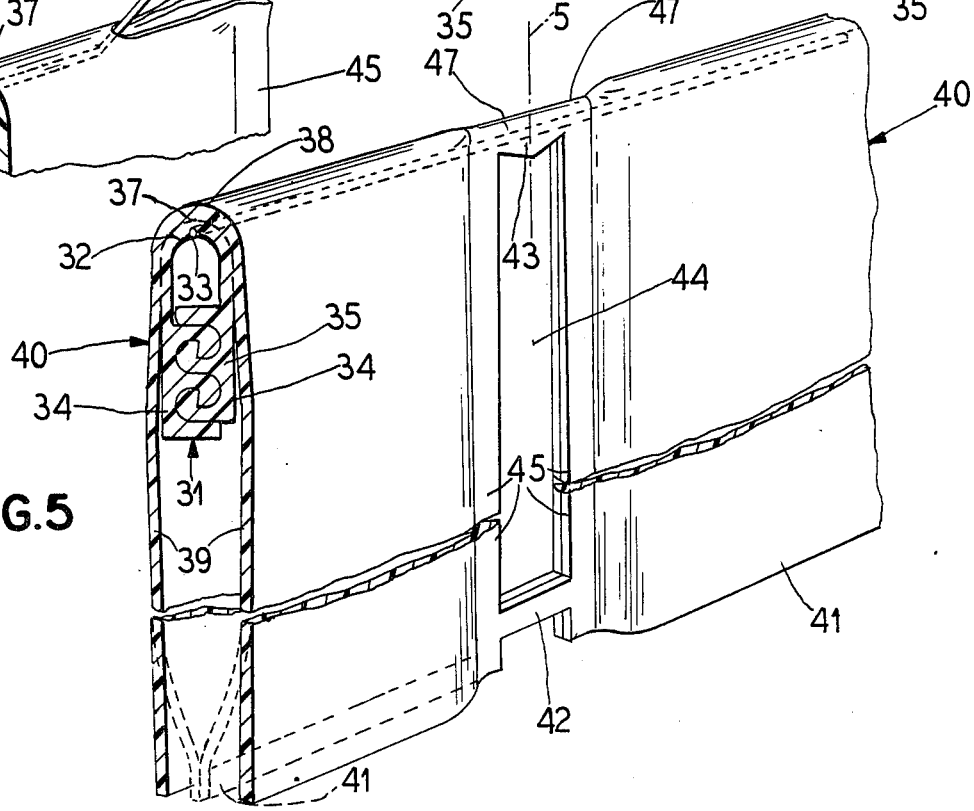
FIG. 5 is a fragmental illustrative view demonstrating how bags incorporating the tear strip of FIG. 4 are adapted to be made.
Figure 13:
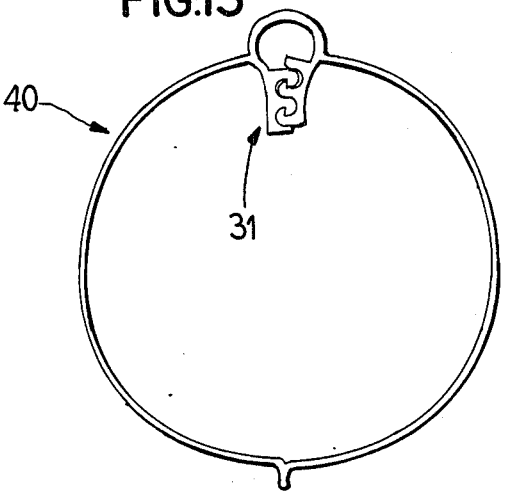
FIG. 13 is a schematic view illustrating test results when a bag made according to FIG. 1 is tested by means of internal air pressure.
Figure 14:
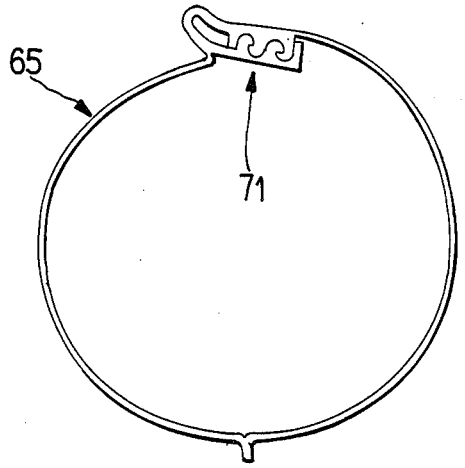
FIG. 14 is a similar schematic view showing how the bag of FIG. 9 responds to internal air pressure testing.

Referring to FIG. 13, a bag constructed substantially according to FIG. 5 was tested by inflating it until internal pressure separated the zipper profiles. It was found that it required two pounds of air pressure to effect the zipper profile pull apart. On the other hand, a bag constructed substantially according to FIGS. 9 through 12 when inflated as represented in FIG. 14, required 3.5 lbs. of air pressure to effect separation of the zipper profiles. Observation of the bags in the two tests showed that whereas there appeared to be an equal separating pull on the zipper in the FIG. 13 test, there appeared to be a separating pull from only one side of the zipper in the FIG. 14 test.

It may be observed that if, instead of fusibly compatible material in the bag making film and the zipper strip, incompatible materials are to be joined such as where the film is formed from a material such as polypropylene which is not fusibly compatible with polyethylene from which the zipper strip may be made, adhesive attachment of the zipper strip to the film may be effected according to now known techniques. This is with the understanding, of course, that at least one of the margins of the zipper strip web, including the full zipper profile thereon will be maintained free from attachment to the bag wall film so as to maintain a free relationship of that web marginal portion and the film, which assures excellent holding strength against pulling open of the zipper by internal forces in the bag. Also, as is known, the bag wall film may be either single ply or multi-ply, whichever may be preferred.

It will be understood that variations and modifications may be effected without departing from the spirit and scope of the novel concepts of the present invention.

I claim as my invention:

1. Apparatus for making bag material, comprising:

means for supporting a sheet of bag wall material;

means for supplying a zipper strip with a web and spaced complementary separably interlockable profiles along opposite margins of said strip;

means for engaging said profiles and guiding said strip into assembly with said sheet;

means for securing said web to said sheet but leaving at least one of said margins free and unattached relative to said sheet so that the sheet can swing away from said one margin;

rotary means for creasing said web along a line between said profiles;

means following said means for creasing for folding said sheet and said web along said crease and effecting nesting of said strip within the fold thus produced;

and means for cross sealing the folded web and zipper strip into bag sections.

2. Apparatus according to claim 1, wherein said securing means comprises fusion energy sealing means.

3. Apparatus according to claim 1, including securing means constructed and arranged for securing the other of said margins along the back of the profile carried thereby to the adjacent portion of said sheet.

4. Apparatus according to claim 1, wherein said other of said margins has a flange extension beyond and profile carried on said other margin, and means for securing said flange extension to the area of said sheet adjacent thereto.

5. Apparatus for making bag material, comprising:

means for supporting a sheet of bag wall material;

means for supplying a zipper strip with a web and complementary separably interlockable profiles along opposite margins of said strip;

means for engaging said profiles and guiding said strip into assembly with said sheet;

means for securing said web to said sheet but leaving at least one of said margins free and unattached relative to said sheet so that the sheet can swing away from said one margin;

means for folding said sheet along said web and effecting nesting of said strip within the fold thus produced;

said folding means comprising a rotary creasing device and a folding device;

means for cross sealing the folded web and zipper strip into bag sections;

said securing means comprising fusion energy sealing means; and combination guiding and heat shielding means between which said securing means operates to effect fusion energy sealing of said web to said sheet.

* * * * *